US006554670B1

(12) United States Patent
Eto

(10) Patent No.: US 6,554,670 B1
(45) **Date of Patent: *Apr. 29, 2003**

(54) METHOD FOR CAPPING LAMPS

(75) Inventor: Gunji Eto, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/574,465

(22) Filed: May 18, 2000

(30) Foreign Application Priority Data

May 21, 1999 (JP) ..... 11-142089

(51) Int. Cl.[7] ..... H01J 9/24
(52) U.S. Cl. ..... 445/23
(58) Field of Search ..... 445/23

(56) References Cited

U.S. PATENT DOCUMENTS 3,897,124 A * 7/1975 Pagnotta et al. ..... 439/734

FOREIGN PATENT DOCUMENTS

| | | | |
|---|---|---|---|
| JP | 56-30247 | A | 3/1981 |
| JP | 62-73552 | A | 4/1987 |
| JP | 6-275244 | A | 9/1994 |
| JP | 8-138631 | A | 5/1996 |
| JP | 8-190867 | A | 7/1996 |
| JP | 10-275602 | A | 10/1998 |
| JP | 10-275602 | | 10/1998 |

* cited by examiner

*Primary Examiner*—Kenneth J. Ramsey
(74) *Attorney, Agent, or Firm*—Merchant & Gould, P.C.

(57) ABSTRACT

A holder having a funnel-shaped portion is provided above an eyelet, and a conductive metal piece is supplied to the vicinity of a portion at which plasma arc welding is performed in the funnel-shaped portion. The conductive metal piece is fused together by plasma arc welding so that the hole of the eyelet is closed completely. Thus, the lead wire can be connected firmly. Therefore, even if the hole diameter of the eyelet is excessively large relative to the diameter of the lead wire, complete closure and sufficient fusion connection can be achieved.

5 Claims, 3 Drawing Sheets

(A)

(B)

METHOD FOR CAPPING LAMPS

BACKGROUND OF THE INVENTION

1. Field of the Invention

The present invention relates to a method for capping a lamp such as various types of incandescent lamps, a high-pressure discharge lamp, a bulb-shaped fluorescent lamp or the like.

2. Description of the Prior Art

Conventionally, in the case where an E-type base is used as the base of a bulb-shaped lamp such as various types of incandescent lamps, a high-pressure discharge lamp and a bulb-shaped fluorescent lamp, plasma arc welding is performed to connect a base eyelet and the end of a lead wire in the center. This method is disclosed in JP 62-73552A and JP 56-30247A.

The conventional method for capping a lamp has the following problems. In the case of a E26 base that is most commonly used for a bulb-shaped lamp, the diameter of the hole through which the lead wire is drawn out of the eyelet is about 1 to 1.6 mm. On the other hand, a lead wire having a relatively small diameter of about 0.1 to 0.5 mm that can act as a fuse for the purpose of improving safety, such as a monel wire, has been used increasingly. Therefore, it has been difficult to fill the hole of the eyelet completely with a molten portion of the lead wire by plasma arc welding, because the difference between the diameter of the hole of the eyelet and the diameter of the lead wire is too large.

FIG. 3 is a view showing the conventional manner in which a base eyelet and a lead wire are connected. As shown in FIG. 3, when the diameter of the hole 9 of the eyelet 5 of the base 2 is excessively large relative to the diameter of the lead wire 8, the molten portion 12 of the lead wire cannot completely fill the hole 9 of the eyelet, and an opening 13 may be generated in the center. Another problem is that the lead wire 8 and the eyelet 5 cannot be welded completely and firmly. Incomplete welding results in poor weld strength, and contamination of foreign substances or poor appearance reduces the commercial value of the product. Thus, the product is not practically usable. On the other hand, if the diameter of the hole 9 of the eyelet is made small, it may be difficult to carry out automatic insertion of the lead wire 8.

SUMMARY OF THE INVENTION

Therefore, with the foregoing in mind, it is an object of the present invention to provide a method for capping a lamp that can achieve complete plasma arc welding between a lead wire and a base eyelet and that improves weld strength.

A method for capping a lamp of the present invention includes drawing out a lead wire from a hole of a base eyelet of a bulb-shaped lamp and fusing the eyelet and the lead wire by plasma arc welding, and is characterized in that a conductive metal piece is supplied to the vicinity of a portion at which the eyelet and the lead wire are fused, and then plasma arc welding is performed. This embodiment allows the supplied conductive metal piece to be molten during plasma arc welding and welded with the base eyelet completely. Therefore, even if the hole diameter of the base eyelet is excessively large relative to the diameter of the lead wire, the hole of the base eyelet can be closed completely with a satisfactory appearance, and the lead wire and the eyelet can be connected completely and firmly.

In the above embodiment, it is preferable to provide a holder having a funnel-shaped portion above the eyelet, and to supply the conductive metal piece into the funnel-shaped portion. This embodiment allows the conductive metal piece to be held in the funnel shaped-portion of the holder until plasma arc welding starts, so that automatic capping of a lamp can be performed easily. Furthermore, selecting an appropriate shape of the funnel shaped-portion allows the conductive metal piece to be supplied easily to the vicinity of the portion to be welded. Thus, the present invention allows automatic production of bulb-shaped lamps and improves productivity. In addition, it is not necessary to modify conventional equipment significantly, because a conductive member that conventionally has been used for plasma arc welding can be used with minor modifications of its shape or the like as the holder.

These and other advantages of the present invention will become apparent to those skilled in the art upon reading and understanding the following detailed description with reference to the accompanying figures.

BRIEF DESCRIPTION OF THE DRAWINGS

FIG. 3(A) is a partial cutaway side cross-sectional view and FIG. 3(B) is a top view.

DESCRIPTION OF THE PREFERRED EMBODIMENTS

Hereinafter, an embodiment of the present invention will be described with reference to the accompanying drawings.

Figure 1:
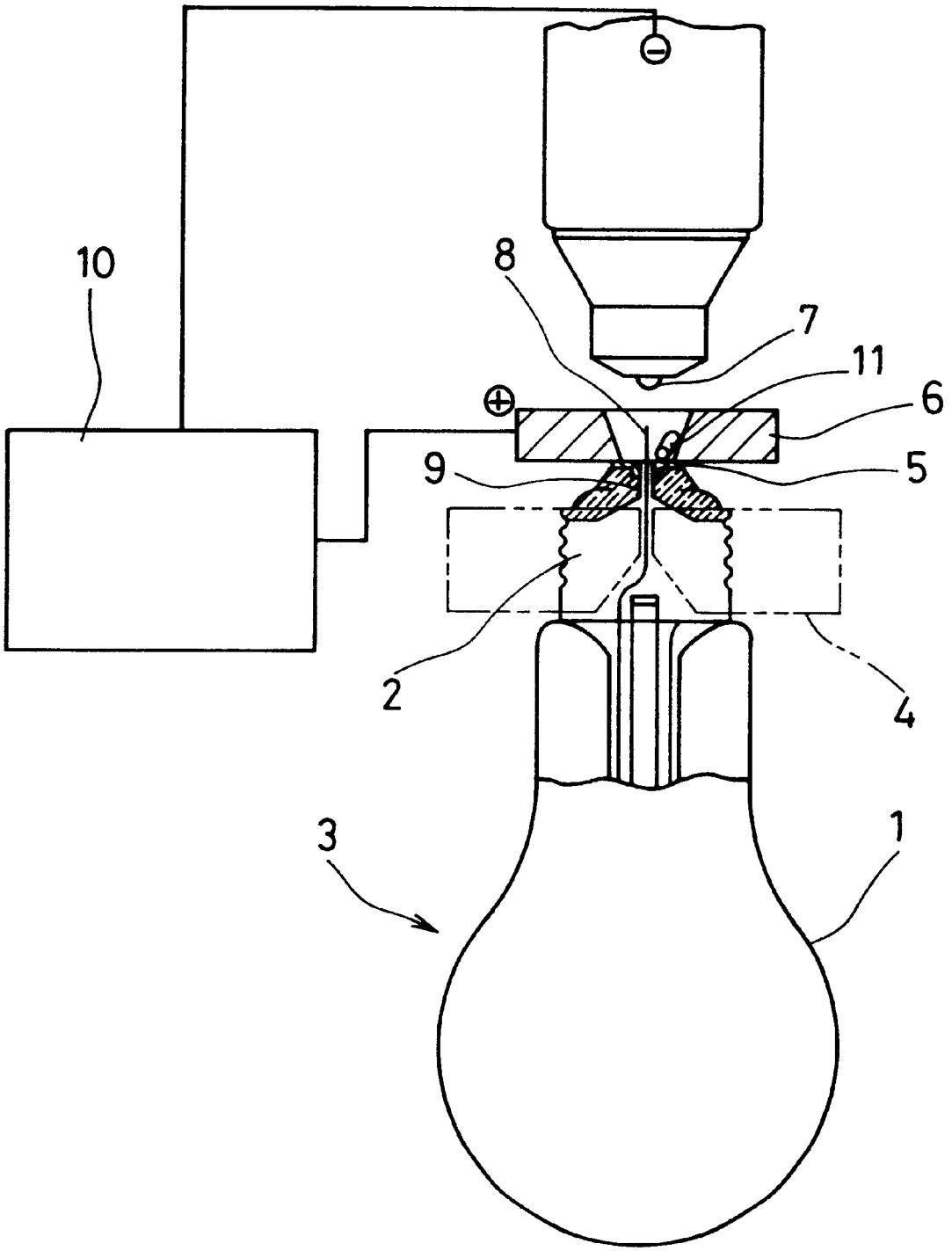
FIG. 1 is a partial cross-sectional side view showing an example of a schematic structure of a method for capping a lamp of the present invention.

FIG. 1 is a cross-sectional side view showing an example of an embodiment of the present invention. A bulb-shaped lamp 3 including a glass bulb 1 provided with a base 2 is held by a base holder 4. A conductive holder 6 provided with a funnel is positioned above an eyelet 5 made of a conductive metal, and a torch 7 of a plasma arc welder 10 is positioned further above the eyelet 5. A lead wire 8 in the center is inserted through a hole 9 of the eyelet 5 and is drawn out. At least one cylindrical conductive metal piece 11 for filling the hole 9 is supplied and placed in the funnel of the holder 6.

The capping is performed in the following manner. Current is applied to the plasma arc welder 10 so that the lead wire 8 and the conductive metal piece 11 are molten to be welded with the eyelet 5 to close the hole 9 completely. Thus, the capping is completed. According to this manner, even if the difference between the diameter of the hole 9 of the eyelet 5 and the diameter of the lead wire 8 is too large, the conductive metal piece 11 allows the lead wire 8 and the eyelet 5 to be connected by welding without any problems, and provides a finished product that is complete and sturdy and appears good.

Hereinafter, an example of the present invention will be described.

Figure 2:
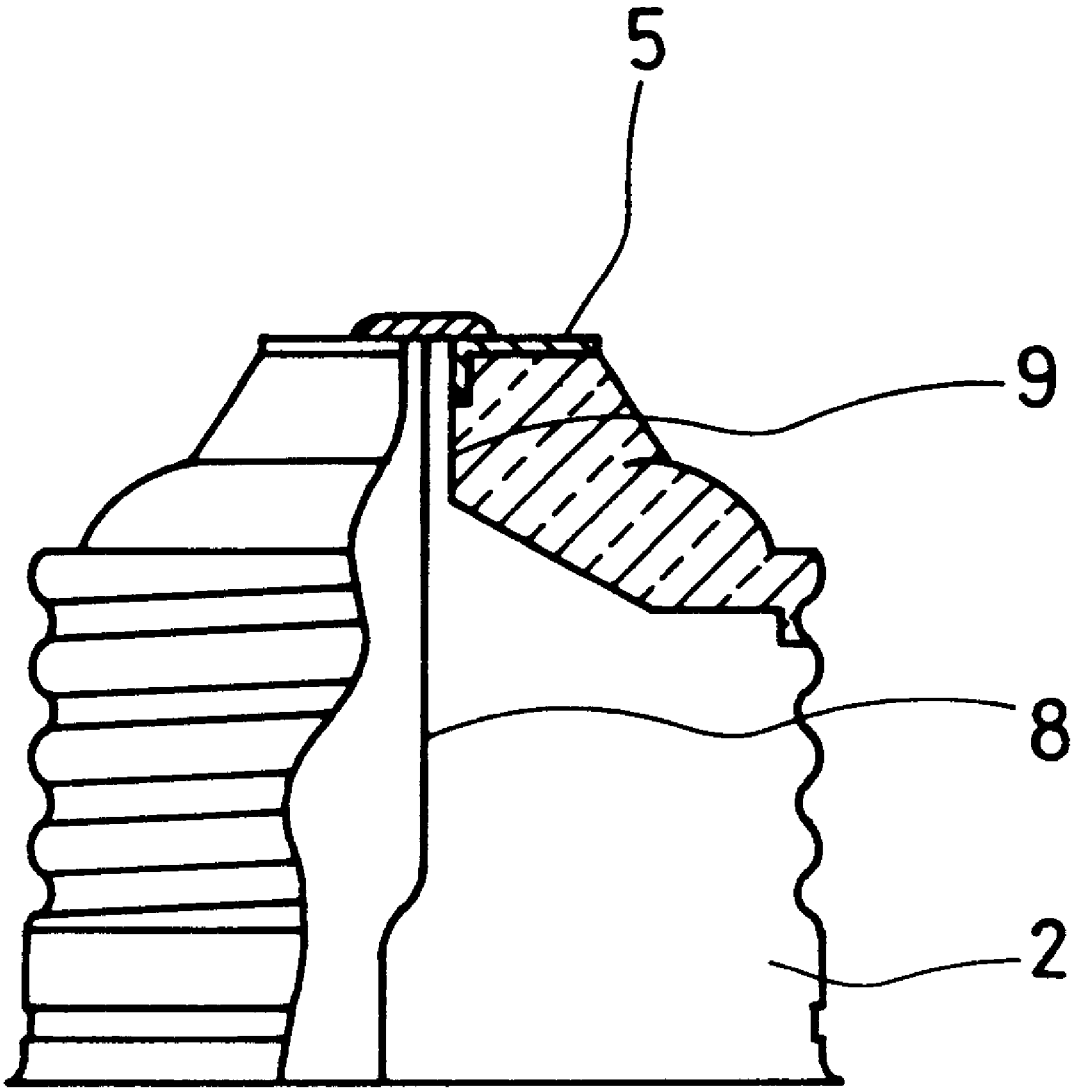
FIG. 2 is a partial cutaway side cross-sectional view of a top portion of base eyelet capped by the method for capping a lamp of the present invention.
Figure 3:
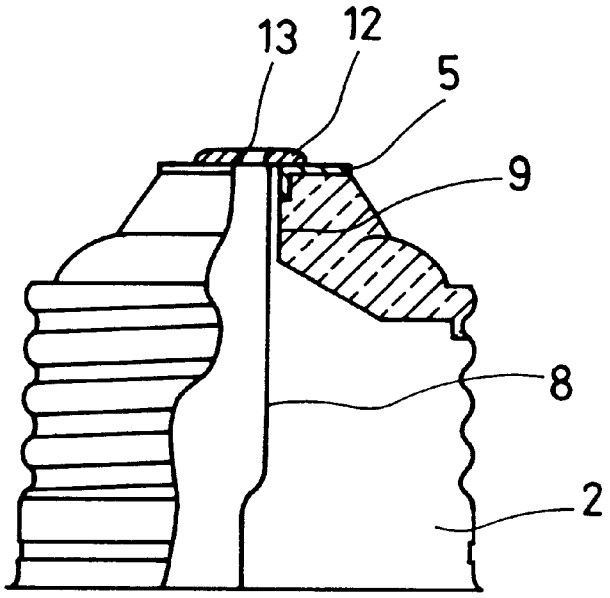
FIG. 3 (PRIOR ART)
FIGS. 3(A) and 3(B) are views showing a conventional manner in which a base eyelet and a lead wire are connected.
Figure 3:
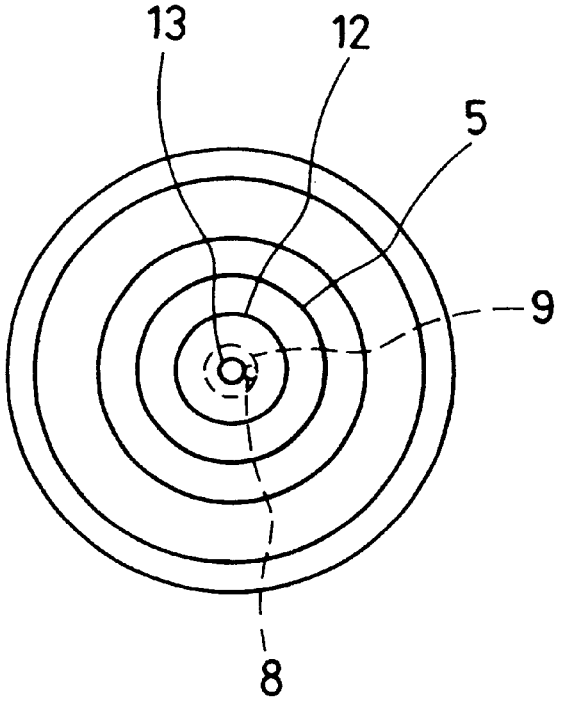
FIG. 3 (PRIOR ART)

The capping of a regular lamp having a rated power of 54 W was carried out with an apparatus as shown in FIG. 1. A commonly used E26 base using brass for the eyelet 5 of the base 2 and having a diameter of the hole 9 of the eyelet of 1.6 mm was subjected to an experiment. A monel wire having a wire diameter of 0.2 mm that can act as a fuse and is commonly used as the lead wire 8 for connection to the eyelet in the center was used, and was extended about 10 mm from the hole 9 of the eyelet. Then, a conductive holder 6 provided with a funnel that is a shape equivalent to that shown in FIG. 1 was positioned above the eyelet 5. Then, a conductive metal piece 11 made of a cylindrical body having a diameter of 1.6 mm and a length of 4 mm and having substantially the same melting point as that of the monel wire was supplied to the vicinity of the eyelet hole 9 and the projected lead wire 8 through the holder 6 and placed close thereto, as shown in FIG. 1. Thereafter, a current of 30A to 40A was applied to the torch 7 of the plasma arc welder 10 and the eyelet 5 so that plasma arc generation melts the conductive metal piece 11 and the lead wire 8 so that they were welded with the eyelet 5. In the plasma arc welding experiment, the lead wire 8 was connected to the base eyelet 5 portion firmly and completely by using the conductive metal, and the eyelet hole portion appeared good and was closed sufficiently, as shown in FIG. 2. Thus, the commercial value of the product was not reduced at all. For comparison, the following experiments were conducted. Conductive metal pieces made of the same material and having a tubular shape, a spherical shape, or a non-spherical shape (e.g., a barrel shape, a rugby ball shape, etc.) were used. The minimum outer diameter of the conductive metal piece for each of the shapes is not less than the diameter of the hole of the eyelet. In these experiments, as in the initial experiment, the capping was achieved satisfactorily without any problems.

In the case where a conductive metal piece made of the same material as in the above experiment and having a minimum outer diameter smaller than that of the hole of the eyelet for each of the shapes was used, the conductive metal piece fell down from the hole 9 to the inside of the base due to shaking or the like when it is supplied through the holder 6 to the eyelet portion. Therefore, it is preferable that the minimum outer diameter of the conductive metal piece to be supplied is equal to or larger than the diameter of the hole 9 of the eyelet. Herein, "the minimum outer diameter" of the conductive metal piece means an outer diameter defined from the viewpoint of whether or not it can pass through the hole 9.

Next, various materials for the conductive metal piece were examined. The results were as follows. When a material having substantially the same composition or substantially the same conductivity as that of the material for the lead wire, or the material having a melting point equal to or smaller than that of the material for the lead wire or the eyelet was used, the connection between the lead wire and the eyelet by fusion and the closure of the eyelet hole were achieved sufficiently by plasma arc welding. For example, in the case where the material for the lead wire is monel wire and the material for the eyelet is brass, it was confirmed that copper, brass or the like is suitable for the material for the conductive metal piece. On the other hand, when a material that does not satisfy the above-described conditions was used for the conductive metal piece, satisfactory results were not obtained as a supplementary material for complete fusion of the lead wire and the eyelet by plasma arc welding.

In the present invention, since the conductive metal piece can be supplied to the base eyelet portion through the funnel shaped-holder from a stock container irregularly, the application of plasma welding work to an apparatus for capping a lamp of an automatic manufacturing machine for lamps does not interfere with the automatic manufacture.

The lamp of the present invention is not limited to a regular lamp as described in the above example, and can be various incandescent lamps, a halogen lamp, a high-pressure discharge lamp or the like using an E-type base or other shaped-base.

The material for the conductive metal piece is not limited to the materials described herein, and any materials can be used, as long as it does not interfere with the plasma arc welding work for connecting the lead wire and the base eyelet. Furthermore, any shape or size can be used, as long as it does not let the conductive metal piece fall down from the hole of the base eyelet to the inside of the base before welding.

The holder with a funnel provided above the base eyelet of the present invention can be partially non-conductive, as long as it has conductivity necessary for plasma arc welding.

As described above, the method for capping a lamp of the present invention can achieve complete and firm connection between the lead wire and the eyelet by plasma arc welding for the base eyelet and the lead wire, even if the diameter of hole of the base eyelet is excessively large relative to that of the lead wire. Moreover, in the present invention, the hole of the base eyelet can be closed completely with a satisfactory appearance. Therefore, the present invention provides great practical advantages over the prior art. In addition, the present invention is suitable for automatic manufacture and provides high production efficiency.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for capping a lamp comprising:

drawing out a lead wire from a hole of a base eyelet of a lamp and fusing the eyelet and the lead wire by plasma arc welding, wherein a conductive metal piece is supplied to a vicinity of a portion at which the eyelet and the lead wire are fused, and then plasma arc welding is performed to melt the conductive metal piece together with the lead wire so that the lead wire is connected to the eyelet.

2. The method for capping a lamp according to claim 1, wherein a holder having a funnel-shaped portion is provided above the eyelet, and the conductive metal piece is supplied into the funnel-shaped portion.

3. The method for capping a lamp according to claim 1, wherein the conductive metal piece has a shape selected from the group consisting of a cylindrical shape, a tubular shape, a spherical shape, and a non-spherical shape, and a minimum diameter thereof is not less than a diameter of the hole of the eyelet.

4. The method for capping a lamp according to claim 1, wherein the conductive metal piece is made of a substantially same material as that of the eyelet or the lead wire.

5. The method for capping a lamp according to claim 1, wherein a melting point of the conductive metal piece is not more than a melting point of a material of the lead wire or a material of the eyelet.

* * * * *